US005632384A

United States Patent [19]

Bélanger et al.

[11] Patent Number: 5,632,384

[45] Date of Patent: May 27, 1997

[54] KEY AND SMALL ARTICLE HOLDER

[76] Inventors: Edouard Bélanger, 2960, rue St-Laurent, Lévis, Québec, Canada, G6V 8P9; Claude Lamontagne, 4, rue de la Gréve-Jolliet, Lévis, Québec, Canada, G6V 8X5

[21] Appl. No.: 419,402

[22] Filed: Apr. 10, 1995

[51] Int. Cl.[6] ..... A47F 7/00

[52] U.S. Cl. ..... 211/10; 211/87; D3/207; 40/657

[58] Field of Search ..... 211/10, 59.1, 87, 211/113; D3/207; 70/456 R, 456 B, 459; 40/657; 294/158, 146, 143

[56] References Cited

U.S. PATENT DOCUMENTS

| | | | |
|---|---|---|---|
| D. 208,720 | 9/1967 | Burkhardt | D3/207 |
| D. 310,600 | 9/1990 | Olferscheidt | D3/207 |
| 947,646 | 1/1910 | Palmenberg | 211/59.1 |
| 1,742,542 | 1/1930 | Howell | 211/13 X |
| 2,188,367 | 1/1940 | Loercher | D3/207 X |
| 2,287,418 | 6/1942 | Dudley | 211/59.1 |
| 2,951,589 | 9/1960 | Dudley | 211/59.1 |
| 2,954,874 | 10/1960 | Rouse | 211/13 |
| 3,850,300 | 11/1974 | Young | 211/59.1 X |

*Primary Examiner*—Robert W. Gibson, Jr.
*Attorney, Agent, or Firm*—David J. French

[57] ABSTRACT

A rack for keys and small articles has multiple split rings to receive and carry such items. The rings are held by a support with feet and a handle. By providing two rows of five rings, keys may be classified and stored on a decimal basis, that cross-references to the last digit of an auto license plate.

10 Claims, 7 Drawing Sheets

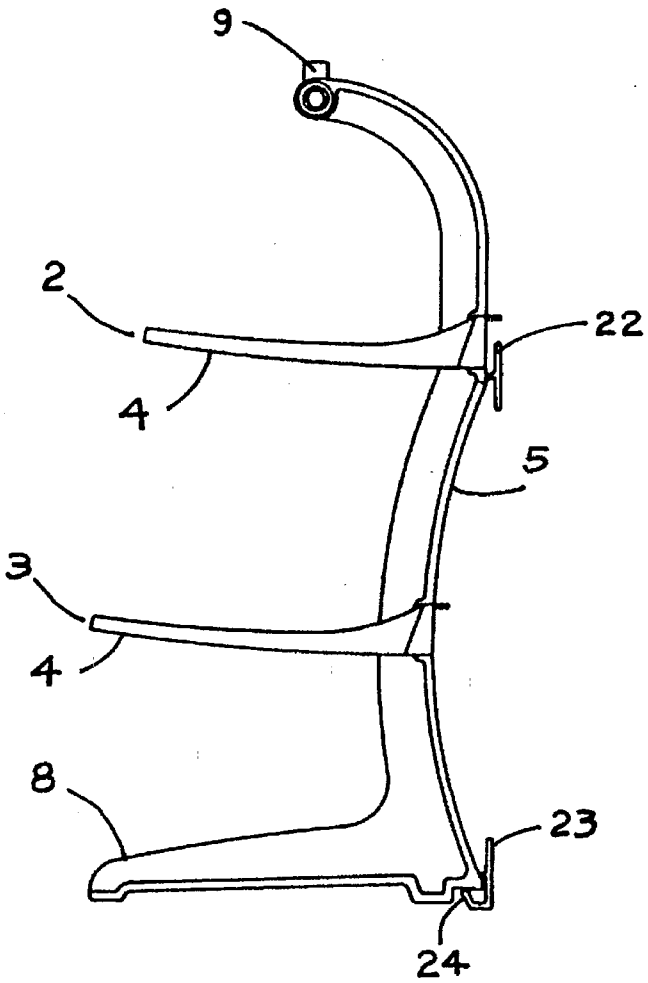
FIGURE #2
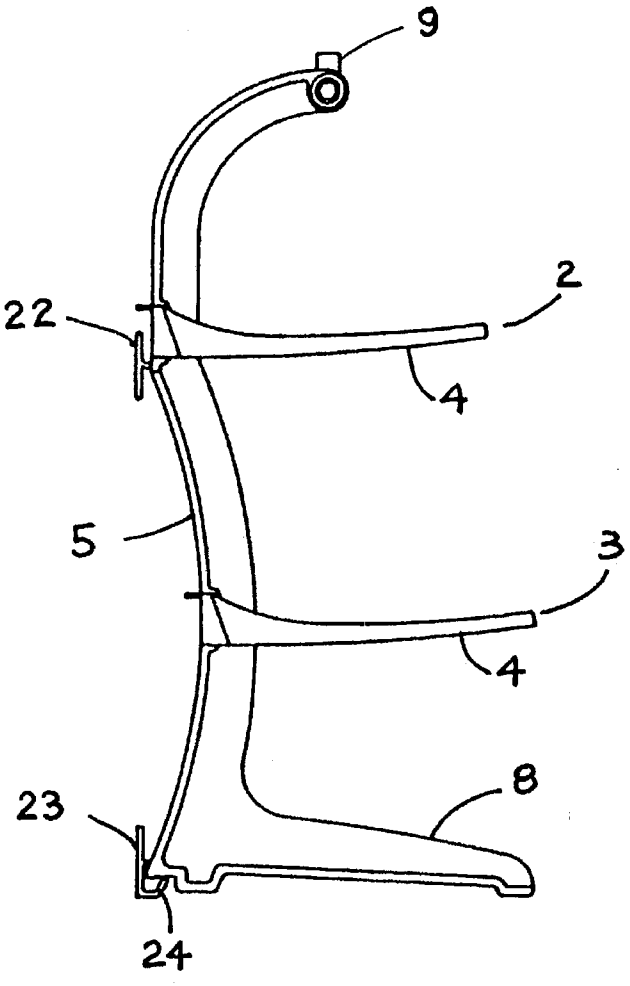
FIGURE #1

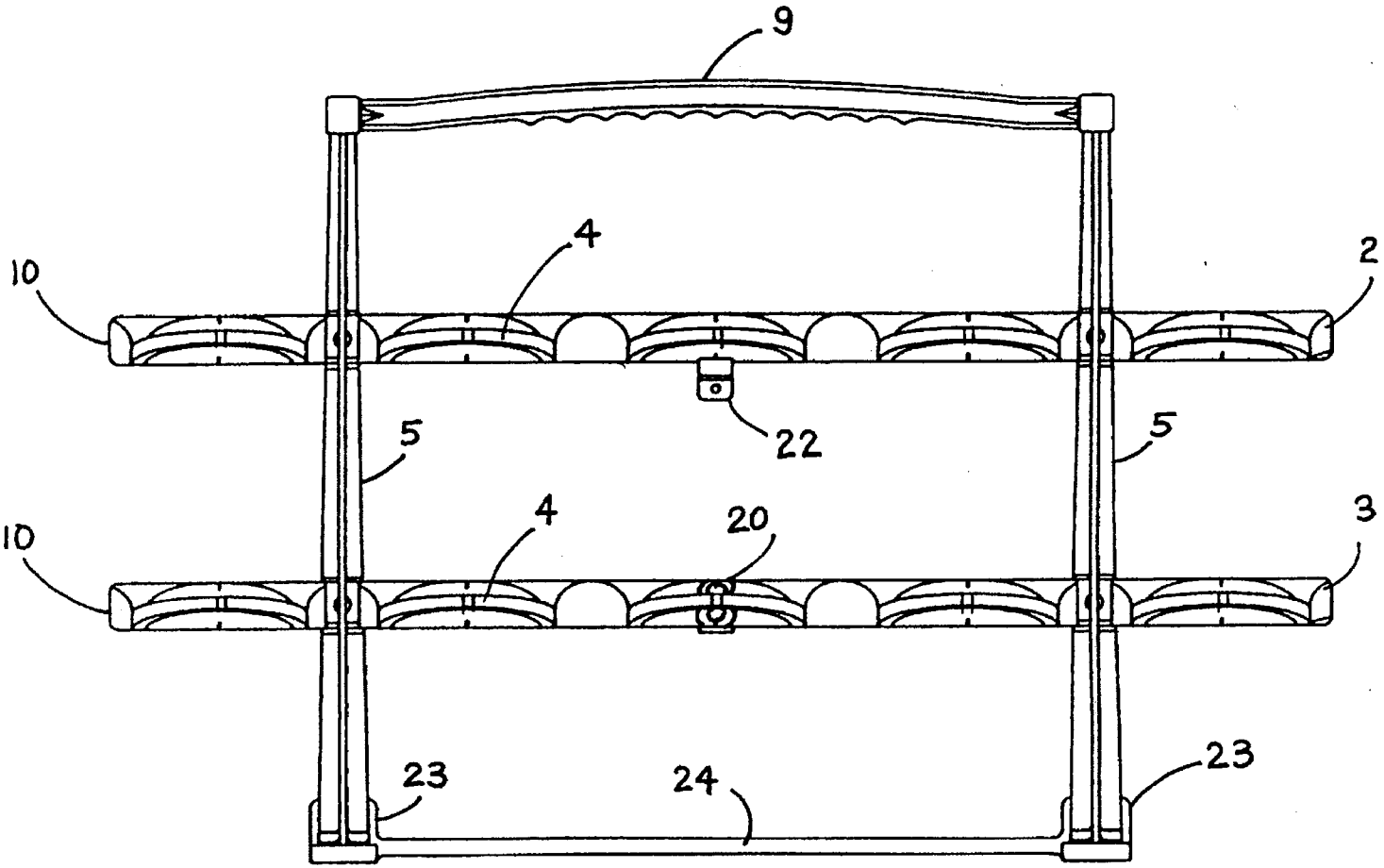
FIGURE #3

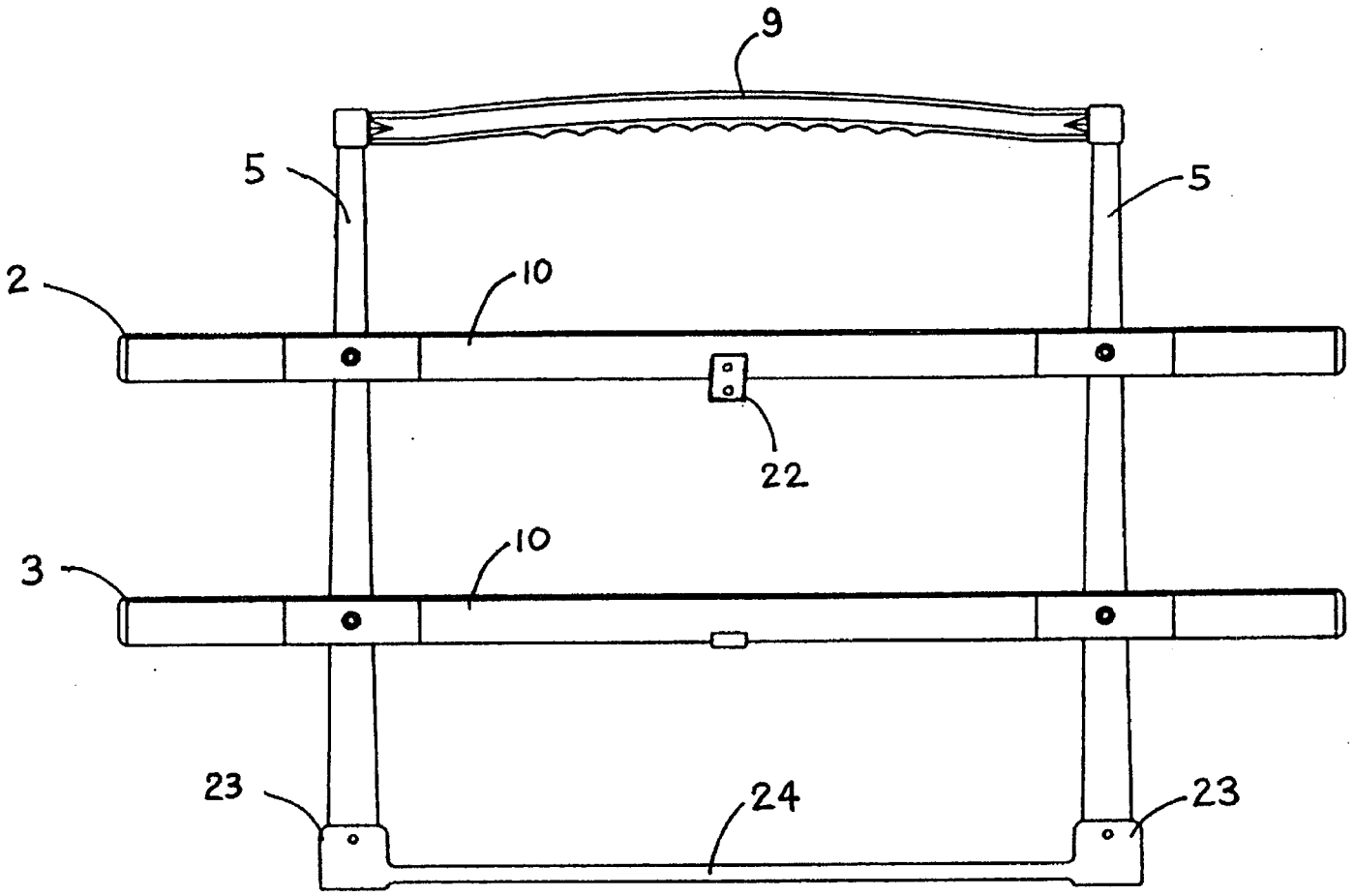
FIGURE #4

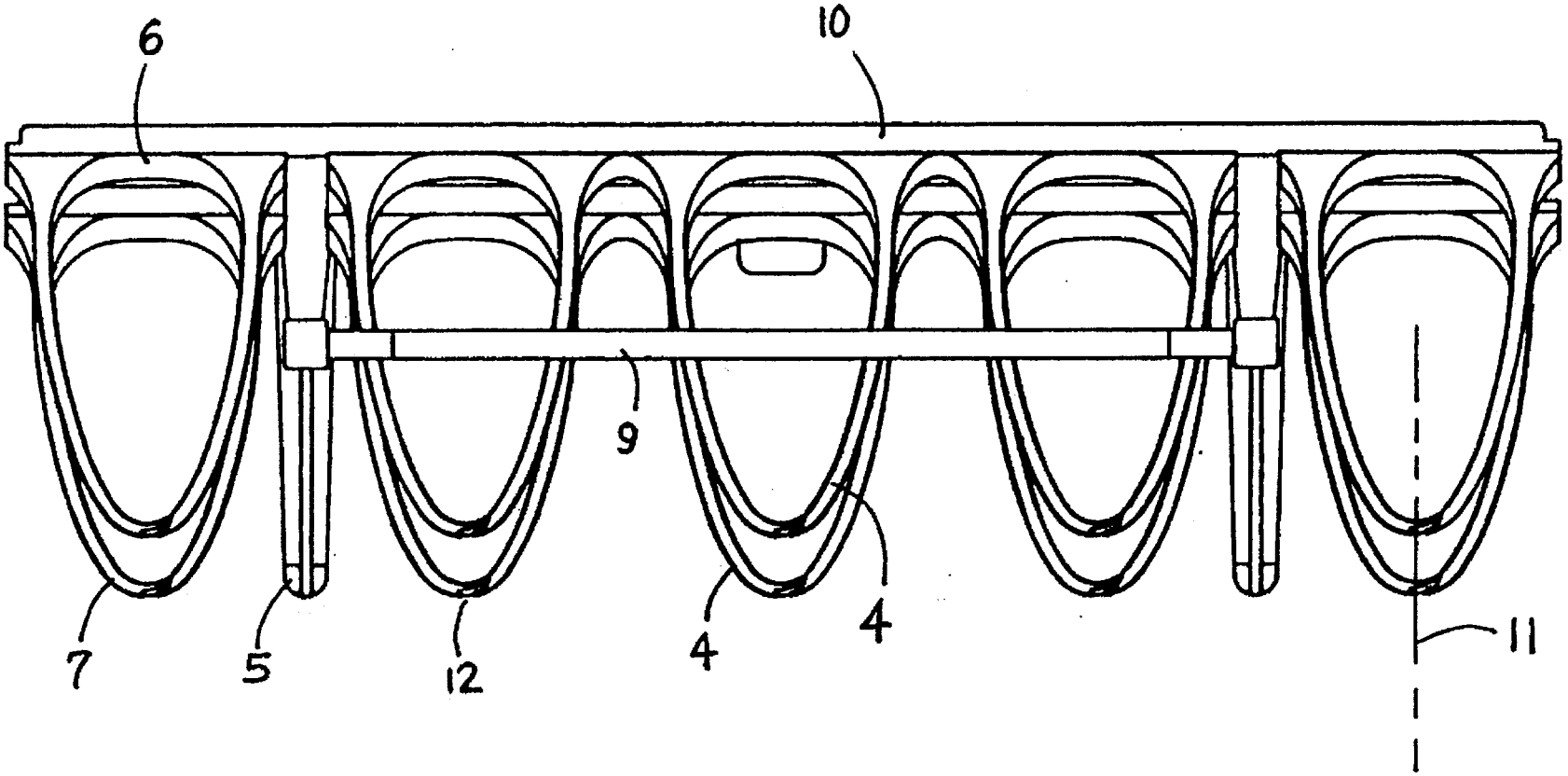
FIGURE #5

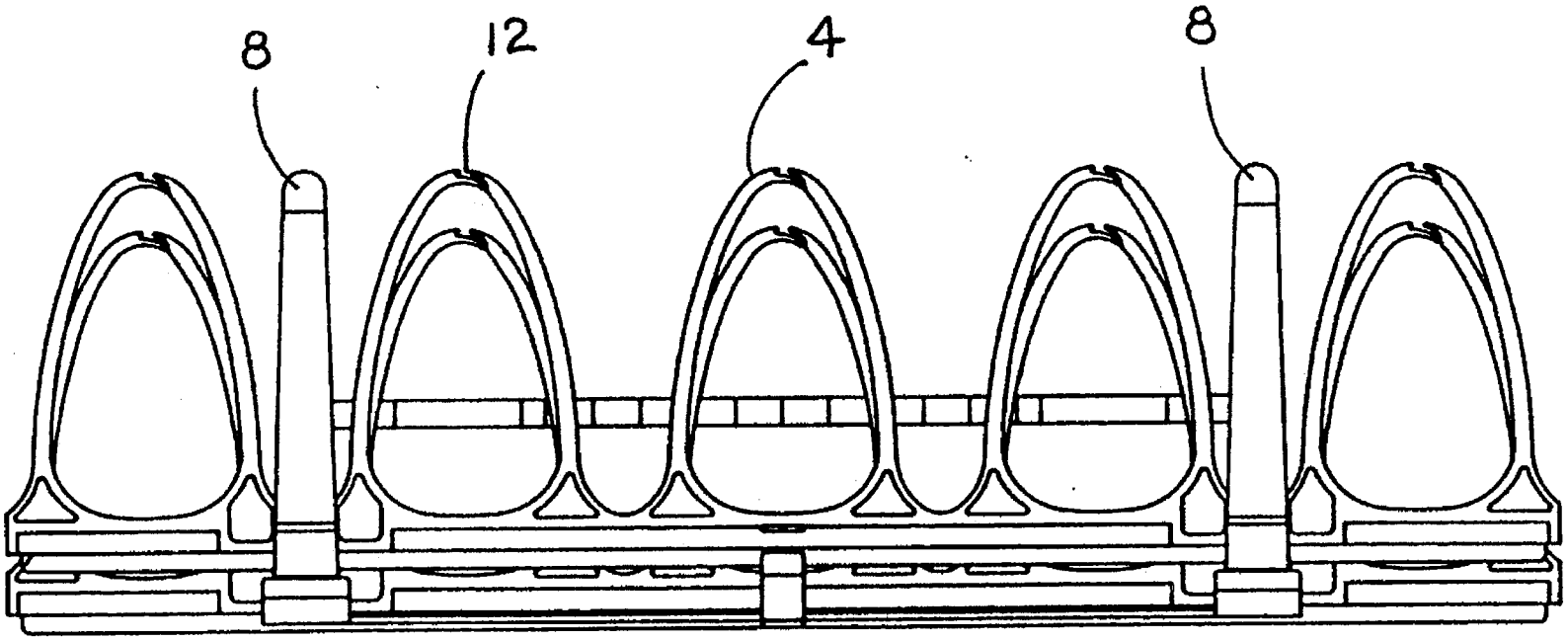
FIGURE #6

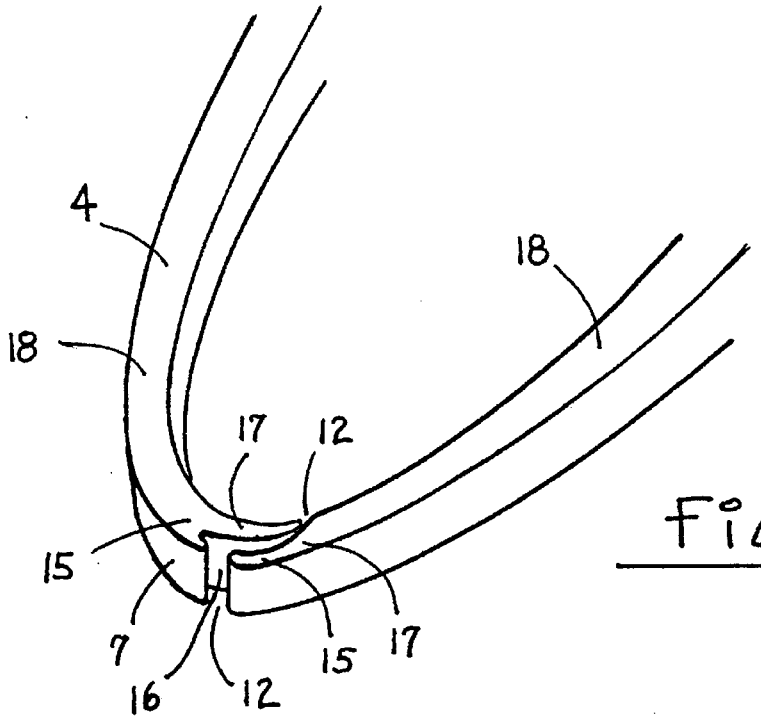
FIGURE #8
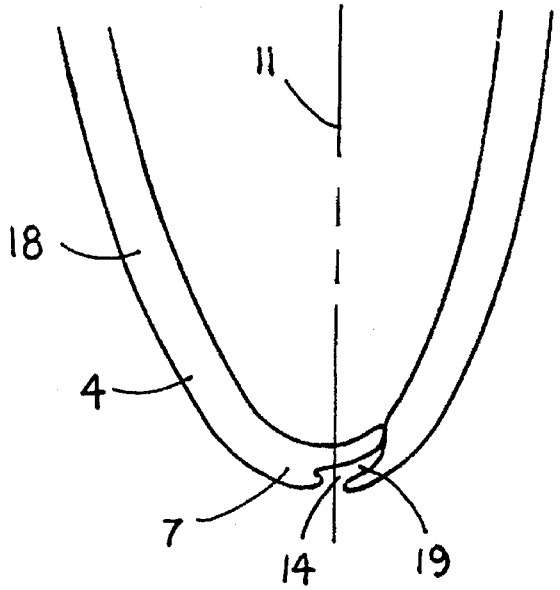
FIGURE #7
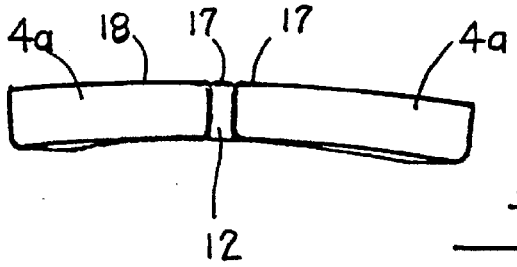
FIGURE #9

FIGURE #10
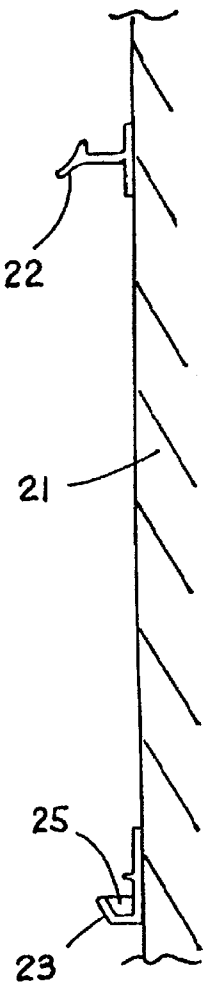
FIGURE #11
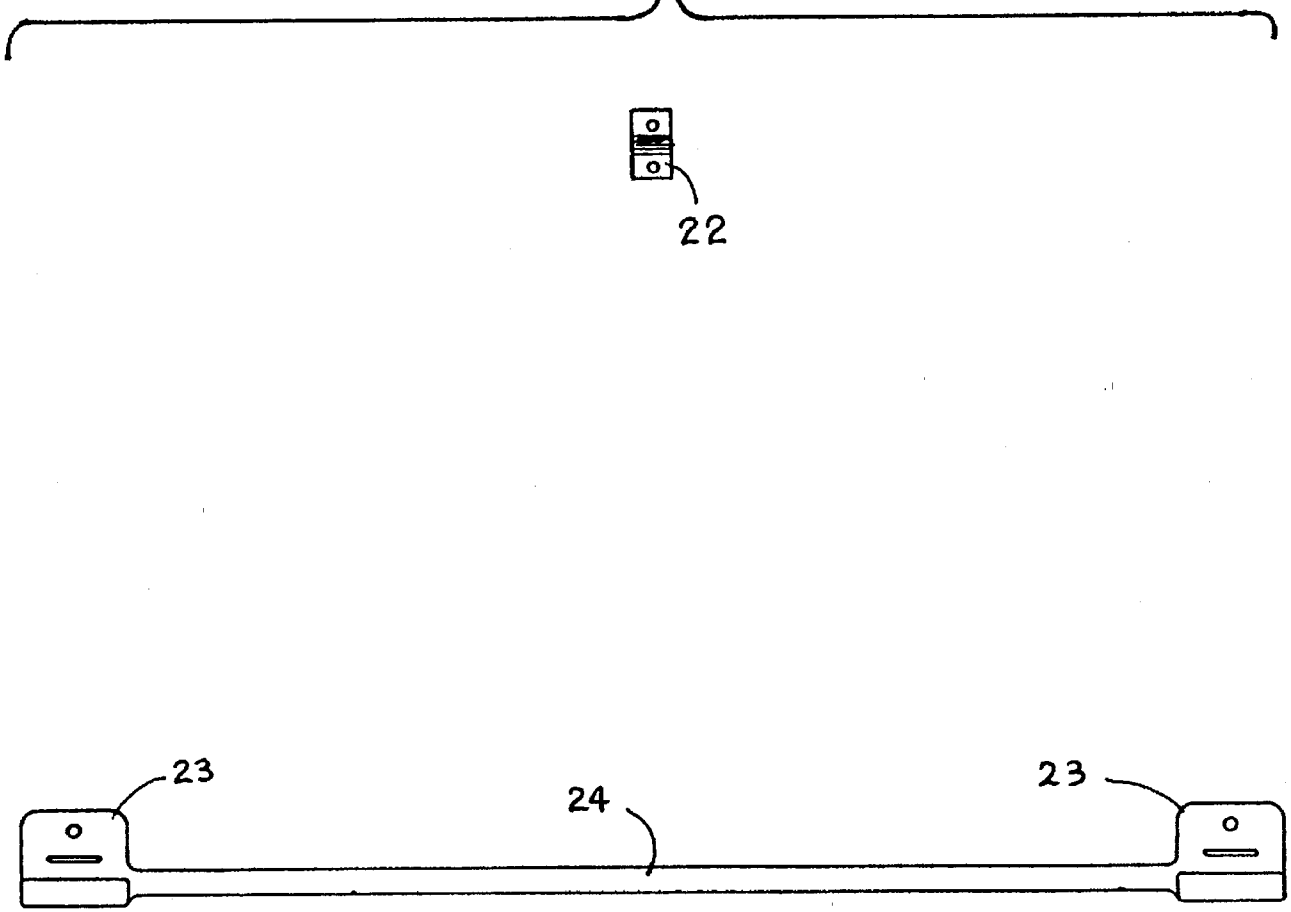

KEY AND SMALL ARTICLE HOLDER

FIELD OF THE INVENTION

This invention relates to support structures and racks. More particularly it is directed to a rack for storing a large number of keys or key sets so that individual key or key sets are readily accessible.

BACKGROUND TO THE INVENTION

The storage of keys is a problem shared by everyone. In the industrial field, numerous keys may have to be kept for a large premises. In the case of parking lot operations it is necessary to rack multiple key or key sets associated with vehicles that have been parked, with these key sets being readily accessible on a random access basis.

While many stationary key racks are known, it would be convenient to provide a rack that is compact and portable, as well as being suited to a stationary location.

As well as keys, a parallel need exists for convenient racks for the storage of small items generally such as rings and jewellery. This invention address such need as well.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to a broad aspect of the invention, a rack for articles is provided with a plurality of split rings that are capable of being elastically separated at a split interface to permit the engagement of articles that are hung on such rings. The rings are preferably oriented in a horizontal plane and are carried by a common support. The support may have feet for positioning the rack in an upright orientation on a horizontal surface, or the support may be provided with means, such as a preformed seat or adaptors for engaging with a hook or hooking system in order to attach the rack to a vertical wall.

Optionally, for portability, the support may connect to a handle by which the rack may be carried. Where the support comprises two vertical posts, the handle may be positioned to bridge between the two upper ends of such posts. Horizontal extensions at the opposite ends of the support posts may serve as feet.

Where the rings protrude forwardly above the feet, the handle is preferably positioned centrally, in line with the approximate centre of mass of the combined rack and load of articles, so that the rack will hang in a balanced, symmetrical manner when carried.

As a preferred configuration, each ring may be oval or egg-shaped in form, with a narrowing end presented forwardly from the support at the rearward end. In such case, the split in the ring is preferable located at the centre of the forward end.

The rings may also be bowed downwardly in the horizontal plane about the centre line extending from the back to the front of each ring. With the split located at this centre line, the ring branches will then fall off downwardly, on either side of the split.

With this bowed shape present, objects placed on the ring will not show a tendency to collect at the split. Rather, they will settle "downhill" so to speak from the split, leaving the split readily accessible to be manipulated when the ring is to be spread to add an article.

To reduce the risk of unintended detachment of the suspended articles from each split ring, the split may follow a curved path, to provide a parting line or split interface which is sinuous. In the latter case inter-engaging fingers may extend from the respective ends of the ring at the split allowing articles to be carried across the split as they are slid from one side to the other. In one variant the inter-engaging fingers may provide a notch or indentation on the front edge of the ring to receive a key or key ring prior to entry of such key or key ring into the passageway provided by the split. Once positioned within this notch, a key ring may be moved laterally to effect the automatic opening of the split and engagement of the key ring with the split ring.

A rack according to the invention can be fabricated from a variety of materials, injection moulded plastic being preferred. Fiber-reinforced nylon-based plastic, in particular, such as that sold under the trade ark BKV-30, will be both elastic and tough, allowing the spit in the rings to be spread repeatedly without becoming sprung.

A rack so formed is both portable and may be hung on a wall by hooking a rearward portion of the support over a nail or hook or equivalent support. A preferred wall support provides lower rail portions and an upper hook to stabilize the rack while keys are being inserted or removed.

A rack according to the invention may be made especially convenient to use by providing indicia associated with each individual split ring. For example, ten split rings may be provided that are respectively labelled from zero to nine. In this manner, the keys or other articles to be stored on the ring may be sub-divided into classes that are assigned to the respective indicia. These indicia may be alphabetic, or may be numbered to some limit other than ten, in accordance with the classes into which the articles are divided.

For example, in the case of keys that are associated with licence plates, the keys may be classified by the last digit of the plate of the vehicle to which they belong. Other classifications based on serial number, etc. may be employed.

The foregoing summarizes the principal features of the invention and some of its optional aspects. The invention may be further understood by the description of the preferred embodiments, in conjunction with the drawings, which now follow.

SUMMARY OF THE FIGURES

FIG. 1 is a side profile view of a rack according to the invention together with a wall-mounting support system;

FIG. 2 is a right side profile view of the rack of FIG. 1;

FIG. 3 is front face view of the rack of FIG. 1;

FIG. 4 is a rear face view of the rack of FIG. 1;

FIG. 5 is a top, plan view of the rack of FIG. 1;

FIG. 6 is a bottom view of the rack of FIG. 1;

FIG. 7 is a plan view of a portion of a sample split ring from the rack of FIG. 1 showing a detail of the split;

FIG.8 is a perspective view of the split ring of FIG. 7;

FIG. 9 is a front view of the split ring of FIG. 7;

FIG. 10 is a side view of the support system for the rack of FIG. 1 mounted on a wall at the parting line for the split; and FIG. 11 is a front view of the support system of FIG. 10.

DESCRIPTION OF THE PREFERRED EMBODIMENT

In FIG. 1 a rack 1 has two rows 2,3 of five rings 4 each. These rows 2,3 are held-up by two support posts 5 connected to each ring 4 through horizontal support bars 10 that carry the rings 4 at their rearward ends 6.

The rings 4 are generally oriented horizontally, although a slight tilt to raise the forward end 7 is desirable to encourage articles, such as keys, to slide rearwardly on each ring 4.

The posts 5 terminate at their bottom ends in horizontally extending feet 8 that underlie the rows 2,3 and hold the rack 1 up when placed on a horizontal surface.

The rings 4 within the rows 2,3 are preferably positioned with at least one ring 4 being located out-board of the posts 5 on either side.

A handle 9 extends between the upper ends of the posts 5 which are curved forwardly so that the handle 9 will overlie the rows 2,3 as well. Although the placement of the handle 9 is not critical, its position should be chosen to minimize the tendency of the rack 1, when typically loaded, to swing when picked-up by the handle.

In FIG. 3 the horizontal support bars 10 can be seen supporting the two rows 2,3 of rings 4. Indicia in the form of numerals from 0 to 9 may be displayed on the rear end 6 of each ring 4 where they join a support bar 10. A sample numeral "8" is shown in the center of the lower row 3 identified by the numeral 20. These may be used to correlate keys, etc. into classes.

The rings 4 as shown in FIGS. 3 and 7–9 are preferably arched about their centre-lines 11 whereby the portions 4*a* of the rings 4 on either side of the split 12 formed centrally at the front end 7 of each ring, fall away in a slight downward curve. This biases keys etc. to settle on the rings 4 at locations spaced from the split 12.

FIGS. 7–9 show a further detail of a preferred parting line path for the split 12. As best seen in FIG. 8 the front ring ends terminate in overlapping fingers 15 to define vertically extending, parting interface surfaces 16. Both finger extensions 15 have upper, top surfaces 17 that align with the upper, top surface 18 of the ring 4 to allow articles to be slid over the split 12 without getting caught.

The rings 4 of FIGS. 7–9 preferably have an access notch or indent 14 formed at the front edge of the fingers 15 that define the split 12. The purpose of this indent 14 is to provide access to the split 12, to ease the spreading of the split 12 by the application of pressure or a prying force through the key or keys which are to be inserted into this indent 14.

This indent extends to form an inner gap 19 that can receive a key ring and allow the finger 15 to be engaged on its inner side to permit the limb of the split ring 4 to be deflected outwardly, widening the split 12 to permit engagement of the key ring with the split ring 4.

The rack of the invention is preferably made of a moulded material that will provide elastic resilience for the rings 4 to be expanded repeatedly without fatiguing.

A preferred wall support for the rack 1 is shown in detail in FIGS. 10 and 11. FIG. 10 shows a side view of a wall 21 with an upper clip 22 and lower rail system 23 fastened thereto. FIG. 11 shows an aligned face view of the side view of FIG. 10.

The rail system 23, which may be divided into separate rail elements conveniently includes a bar 24 to maintain alignment of the ends of the rail 23 where ledges 25 are provided for supporting the posts 5 at their bottom rear edges. The support of the rail system 23 prevents the rack 1 from rocking laterally.

The upper clip 22 engages centrally with the bottom of the upper horizontal support bar 10. This clip 22 may be elastically deformable to permit the rack 1 to be "snapped-in" when positioned in place, and readily released. The clip 22 prevents the rack 1 from toppling forward away from the wall 21.

With this wall support system in use, the rack 1 will be stabilized, allowing force to be applied to the split rings 4 when installing and removing keys and the like.

Conclusion

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property are claimed as follows:

1. A rack for articles, such rack having a frame means carrying a plurality of split rings, each ring:

(1) having a split interface in the form of a split that is capable of being elastically separated manually to permit the engagement of articles to be hung on such rings; and (2) being positioned within a row of rings wherein each of said rings within the row is oriented to lie within a generally horizontal plane.

2. A rack as in claim 1 wherein the rings within a row of rings each lie within the same generally horizontal plane.

3. A rack as in claim 1 wherein the frame means is carried by a support having feet for positioning the rack in an upright orientation on a horizontal surface, said rack further comprising a handle connected to the frame means by which the rack may be carried.

4. A rack as in claim 3 wherein the frame. means comprises two vertical posts and with upper ends that are inclined forwardly to terminate over the plurality of split rings, the handle being positioned to bridge between the two upper ends of such posts in line with the approximate centre of mass of the combined rack with articles positioned thereon, so that the rack will hang in a balanced, symmetrical manner when carried.

5. A rack as in claim 1 wherein said frame means comprises a horizontal support bar that carries at least a portion of the split rings, in combination with hanging means for attaching the rack to a vertical wall, wherein the hanging means comprises:

(1) a horizontal rail element for supporting the lower ends of the two vertical posts; and (2) clip means for engaging the horizontal bar.

6. A rack as in claim 1 wherein each ring is generally oval-shaped in form, with a narrowing end presented forwardly from the frame means and with the split in each ring being located centrally of the forward end of each ring.

7. A rack as in claim 1 wherein:

(a) each ring has a centre line extending from the back to the front of each ring and dividing each ring into two portions; and (b) each of said portions is respectively bowed downwardly in the horizontal plane about said centre line, the split in each ring being located at the front of each ring along this centre line.

8. A rack as in claim 1 wherein the split provides a sinuous parting line defined by inter-engaging fingers extending from the respective ends of the split to permit articles to be carried across the split as they are slid from one side of the ring to the other, and wherein said rings are provided with an access notch formed between the fingers at the split whereby an article entering the access notch may be used to pry the split open and allow engagement of such article with the ring.

9. A rack as in claim 6 wherein the split provides a sinuous parting line defined by inter-engaging fingers extending from the respective ends of the split to permit articles to be carried across the split as they are slid from one side of the ring to the other, and wherein said rings are provided with an access notch formed between the fingers at the split whereby an article entering the access notch may be used to pry the split open and allow engagement of such article with the ring.

10. A rack as in claim 7 wherein the split provides a sinuous parting line defined by inter-engaging fingers extending from the respective ends of the split to permit articles to be carried across the split as they are slid from one side of the ring to the other, and wherein said rings are provided with an access notch formed between the fingers at the split whereby an article entering the access notch may be used to pry the split open an allow engagement of such article with the ring.

* * * * *